United States Patent [19]

Bianchi

[11] Patent Number: 4,572,945

[45] Date of Patent: Feb. 25, 1986

[54] RESET MECHANISM

[75] Inventor: Julio J. Bianchi, Buenos Aires, Argentina

[73] Assignee: General Electric Company, Somersworth, N.H.

[21] Appl. No.: 675,281

[22] Filed: Nov. 27, 1984

[30] Foreign Application Priority Data

Nov. 29, 1983 [BR] Brazil ..... 8306566

[51] Int. Cl.[4] ..... G06C 15/42

[52] U.S. Cl. ..... 235/144 SP; 235/117 R; 235/130 R; 235/139 R

[58] Field of Search ..... 235/144 S, 144 M, 144 SM, 235/144 SP, 144 DM, 139 R, 117 R, 130 R; 74/361, 366

[56] References Cited

U.S. PATENT DOCUMENTS 3,062,444 11/1962 Grip ..... 234/144 M 3,147,918 9/1964 Vroom ..... 235/144 M X

*Primary Examiner*—Benjamin R. Fuller

*Attorney, Agent, or Firm*—Robert E. Brunson; Thomas R. Morrison

[57] ABSTRACT

A reset mechanism for a cyclometer register employs teeth formed on an axially resiliently urged shaft to engage abutments formed on cyclometer drums to permit resetting of the cyclometer drums. The teeth are normally maintained out of alignment with the abutments by resilient urging of a spring and are manually displaced into engagement for resetting. Carry pinions on a pinion shaft are urged into mesh with respective gearwheels on the cyclometer drums by a pair of springs. During resetting, the pinion shaft, with its pinions, is displaced outward. When the pinions are displaced outward, one or more teeth on each pinion enter a window disposed adjacent thereto in the frame of the cyclometer register. The windows lock the pinions into a predetermined angular position which enables proper mesh to be made with the gearwheels at the conclusion of the resetting operation when the springs again urge the pinions into meshed engagement.

8 Claims, 5 Drawing Figures

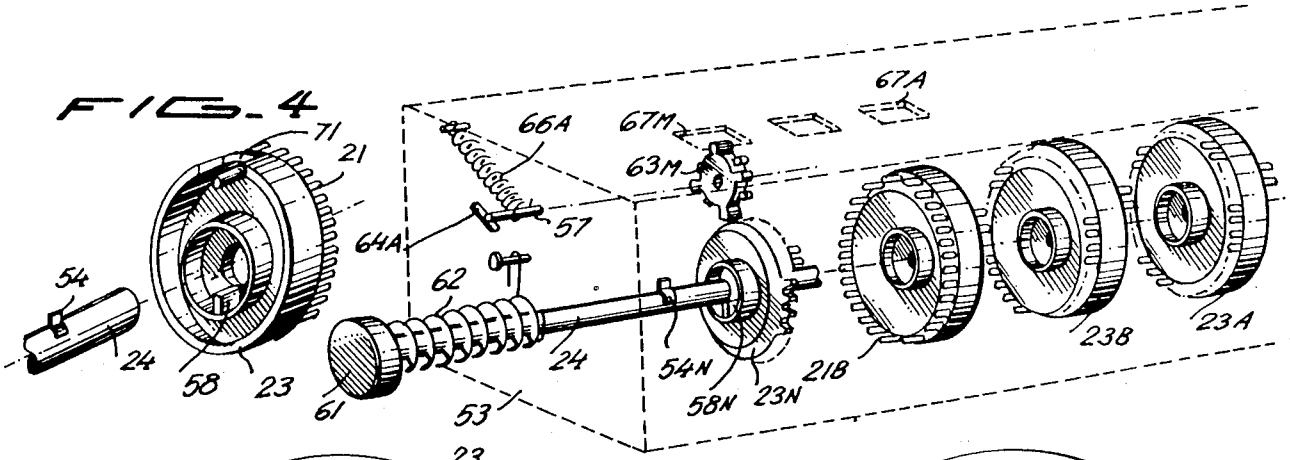
FIG. 4
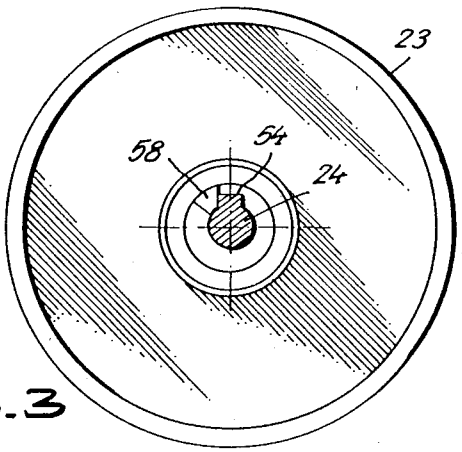
FIG. 5
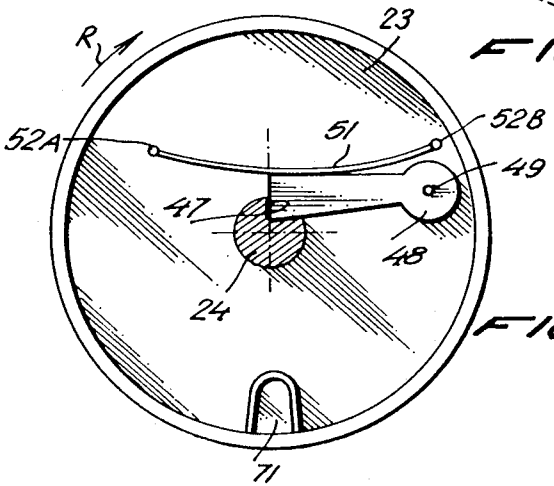
FIG. 1
FIG. 3

RESET MECHANISM

BACKGROUND OF THE INVENTION

The present invention relates to data accumulating devices and, more particularly, to cyclometer registers for data accumulating devices.

Cyclometer registers are commonly employed for accumulating measured quantities such as, for example, distance, time and other types of data. A common type of cyclometer register is found in an electric meter for totalling the number of rotations of a rotor disk to store and indicate the amount of electricity consumed by a load. Although the reset mechanism of the present invention may be usable in other measurement devices, an embodiment of the invention applied to registers for electric meters is selected as the environment in which the invention is described.

Cyclometer registers conventionally consist of a plurality of cyclometer drums on a common shaft each having the numerals 0–9 disposed on the peripheral surface thereof. The reading of the cyclometer register is made up of the series of numerals formed by the set made up of one numeral from each of the cyclometer drums. The lowest-significance one of the cyclometer drums is driven by a process whose data is to be measured. A set of carry pinions are interposed between adjacent ones of the cyclometer drums. As a cyclometer drum completes a revolution and performs a transition from 9 to 0, the interposed carry pinion advances or indexes the next higher cyclometer drum by one digit.

It is desirable to provide a mechanism for resetting all of the cyclometer drums to some known value such as, for example, zero. This is conventionally performed by ratchet devices which are spring-loaded to idle against the stationary drum shaft during normal operation. When the drum shaft is rotated, each ratchet device begins rotating its cyclometer drum as it reaches a certain relationship therewith to finally rotate all cyclometer drums together to the desired setting.

The desire to reduce the power burden for driving electric meters encourages the use of low-torque driving apparatus therein. Ratchet-type reset mechanisms of the prior art, by idling against the cyclometer drum shaft during normal operation, add an undesirable amount of friction to the operation of the register.

OBJECTS AND SUMMARY OF THE INVENTION

Accordingly, it is an object of the invention to provide a reset mechanism which overcomes the drawbacks of the prior art.

It is a further object of the invention to provide a reset mechanism for a cyclometer register which is spring-loaded to remain out of contact with the cyclometer drums thereof during normal operation of the cyclometer register and is displaceable into contact with the cyclometer drums during resetting thereof.

It is a still further object of the invention to provide a reset mechanism for a cyclometer register which adds no additional friction load to the cyclometer register during normal operation thereof.

It is a still further object of the invention to provide a reset mechanism for a cyclometer register which disengages carry pinions from mesh with the cyclometer drums during resetting.

It is a still further object of the invention to provide a reset mechanism for a cyclometer register which includes an apparatus for locking the carry pinions of the cyclometer register in a predetermined angular position during the resetting operation to insure that a predetermined mesh is attained between the carry pinions and the cyclometer drums at the end of the resetting operation.

Briefly stated, the present invention provides a reset mechanism for a cyclometer register employing teeth formed on an axially resiliently urged shaft to engage abutments formed on cyclometer drums to permit resetting of the cyclometer drums. The teeth are normally maintained out of alignment with the abutments by resilient urging of a spring and are manually displaced into engagement for resetting. Carry pinions on a pinion shaft are urged into mesh with respective gearwheels on the cyclometer drums by a pair of springs. During resetting, the pinion shaft, with its pinions, is displaced outward. When the pinions are displaced outward, one or more teeth on each pinion enter a window disposed adjacent thereto in the frame of the cyclometer register. The windows lock the pinions into a predetermined angular position which enables proper mesh to be made with the gearwheels at the conclusion of the resetting operation when the springs again urge the pinions into meshed engagement.

According to an embodiment of the invention, there is provided a reset mechanism for a cyclometer register of a type having a plurality of cyclometer drums on a drum shaft, comprising resilient means for urging the drum shaft into a first axial position, means for permitting manually displacing the drum shaft into a second axial position against an urging of the resilient means, at least two teeth on the drum shaft, an abutment on at least two of the cyclometer drums, the teeth and the abutments being mutually positioned to permit abutment therebetween during rotation of the drum shaft when the drum shaft is manually displaced into the second axial position, whereby manual resetting of the cyclometer register is enabled and the teeth and the abutments being further mutually positioned to avoid abutment therebetween when the drum shaft is in the first axial position whereby normal operation of the cyclometer register is enabled without a retarding friction being applied by the reset mechanism.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 is a transverse cross section of a portion of a cyclometer register illustrating a reset mechanism according to the prior art.

FIG. 3 is a transverse cross section of a portion of the cyclometer register of FIG. 2 illustrating the relationships between the tooth and abutment of the resetting mechanism thereof.

FIG. 4 is a perspective view of a shaft and a cyclometer drum of the cyclometer register of FIG. 2 further showing the relationship illustrated in FIG. 3.

FIG. 5 is a perspective view of a portion of the cyclometer register of FIG. 2 illustrating the apparatus for permitting disengagement and locking of the carry pinions during resetting of the cyclometer register.

DETAILED DESCRIPTION OF THE PREFERRED EMBODIMENT

Figure 2:
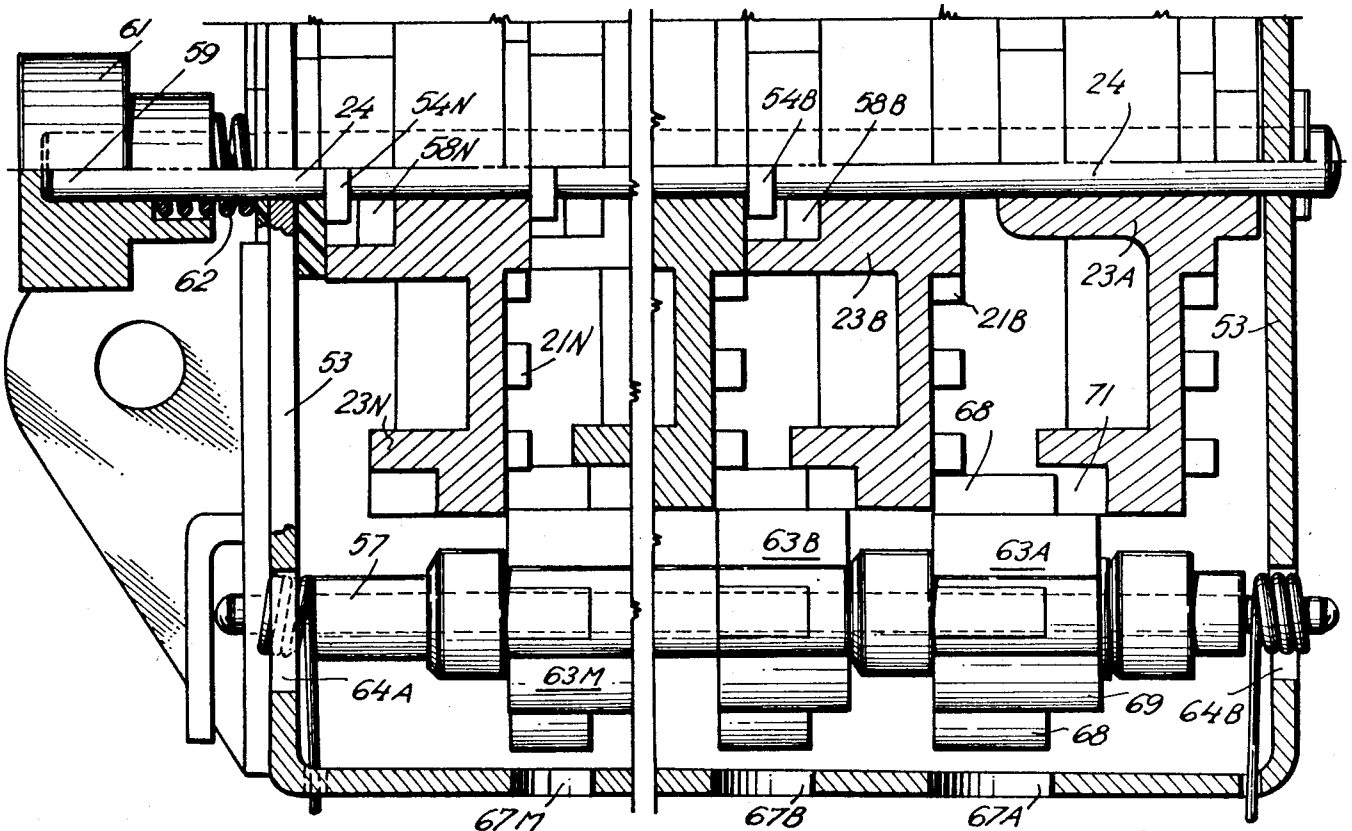
FIG. 2 is a longitudinal cross section of a cyclometer register including a reset mechanism according to an embodiment of the present invention.

Referring first to FIG. 1, there is shown a portion of a resetting mechanism according to the prior art. A single cyclometer drum 23, which is understood to be a representative one of a larger number thereof, is disposed for rotation in a direction R on a normally stationary drum shaft 24. A V-shaped key seat 47 is longitudinally disposed in shaft 24. A brake member 48 is pivoted to cyclometer drum 23 by a pivot 49. The end of brake member 48 remote from pivot 49 is shaped for ratcheting engagement with key seat 47. A spring 51, having its ends 52A and 52B engaged in cyclometer drum 23 resiliently urges brake member 48 into contact with drum shaft 24.

When cyclometer drum 23 rotates in the direction R on stationary drum shaft 24, brake member 48 idles against the surface of drum shaft 24 but does not engage it. The resiliently urged idling contact between brake member 48 and drum shaft 24 adds an undesirable resistance to rotation of cyclometer drum 23. During resetting, drum shaft 24 is rotated in the direction R. At some angular position of drum shaft 24, key seat 47 engages the end of brake member 48, thereby rotating cyclometer drum 23 in the direction R. During a full rotation of drum shaft 24, each of the cyclometer drums 23 is similarly engaged at different times until all cyclometer drums 23 are angularly aligned and rotated into a zero (or other desired) condition.

Referring now to FIG. 2, a set of cyclometer drums 23, 23A through 23N, are mounted for rotation on drum shaft 24 within a frame 53. Drum shaft 24 is resiliently urged toward the left in FIG. 2 by a spring 62 and is free to be manually displaced toward the right. A resetting knob 61 on an end 59 of drum shaft 24 aids in the rightward manual displacement of shaft 24 to perform the resetting operation, as will be explained. A plurality of teeth 54, 54B through 54N, are integrally formed on drum shaft 24. Cyclometer drums 23B through 23N include an abutment 58, 58B through 58N, disposed in a radial position where it is contactable by its respective tooth 54 when drum shaft 24 is manually displaced in the rightward direction. During normal operation, each tooth 54 is maintained in the position shown spaced from its corresponding abutment 58. Any imbalance in cyclometer drum 23 due to the presence of abutment 58 thereon can be compensated for by the addition of a suitable counterweight during manufacture.

Referring momentarily to FIGS. 3 and 4, it will be noted that tooth 54, extending outward from drum shaft 24, is in a radial position to contact abutment 58, extending inward from cyclometer drum 23 when drum shaft 24 is displaced against the urging of spring 62 to place them in axial alignment. When drum shaft 24 is urged into the normal axial position shown in FIG. 2, however, no contact occurs between teeth 54 and abutments 58. Thus, the presence of the resetting mechanism avoids friction or other retarding effects which could interfere with operation of the cyclometer register.

Referring again to FIG. 2, a plurality of pinions 63, 63A through 63M, are disposed for free rotation on a pinion shaft 57. Each pinion 63 such as, for example, pinion 63A, includes an axially short tooth 68 and an axially long tooth 69 alternately disposed about the circumference thereof. A gearwheel 21 in each cyclometer drum 23 engages both the axially short teeth 68 and axially long teeth 69 of the pinion 63 connecting it to its lower-significance neighboring cyclometer drum 23. Axially long teeth 69 normally abut the external surface of their respective lower-significance cyclometer drums 23 thereby locking the pinion 63, as well as the higher-significance cyclometer drum 23, during the entire rotation of the lower-significance cyclometer drum 23, except during the time that the lower-significance cyclometer drum 23 makes a 9–0 transition. During a 9–0 transition of the lower-significance cyclometer drum 23, a slot 71 rotates into alignment with the next axially long tooth 69 which thereupon is enabled to enter it. This temporarily unlocks pinion 63 and permits pinion 63 to index forward by an angular amount determined by the pitch of axially long teeth 69. As pinion 63 is indexed forward, its higher-significance gearwheel 21 and cyclometer drum 23 is advanced with it. In this manner, each cyclometer drum 23 having a higher significance than cyclometer drum 23A is advanced in incremental steps coincident with the 9–0 transition of its next lower-significance cyclometer drum 23. Although a similar indexing could be employed for lowest-significance cyclometer drum 23A, such indexing is frequently omitted, as in the illustrated embodiment, to take advantage of the simplicity offered by direct drive of cyclometer drum 23A.

Referring now also to FIG. 5, opposed ends of pinion shaft 57 (whose axis is indicated by dot-dash line) are slidably disposed in guide slots 64A and 64B (guide slot 64B is shown only in FIG. 2). Springs 66A and 66B (spring 66B is shown only in FIG. 2) urge the opposed ends of pinion shaft 57 along guide slots 64A and 64B thereby to urge pinions 63A through 63M into engagement with gearwheels 21B through 21N and to urge axially long teeth 69 into their locking positions against the peripheral surfaces of their respective cyclometer drums 23.

A plurality of windows 67, 67A through 67M, are disposed in frame 53 closely spaced adjacent to pinions 63A through 63M. Each window 67 has an axial length sufficient to admit one or more axially short teeth 68 of its pinion 63 but insufficient to admit a portion of an axially long tooth 69 extending past the axial length of axially short teeth 68.

The cyclometer register is reset by manually displacing drum shaft 24 (FIG. 2) rightward against the urging of spring 62 until teeth 54 are axially disposed to contact their respective abutments 58, and rotating drum shaft 24 using resetting knob 61. As each tooth 54 rotates into abutment with its respective abutment 58 it rotates its cyclometer drum 23, except for cyclometer drum 23A, until the desired reset condition (conventionally zero) is attained. The rotation of cyclometer drums 23 displaces pinion shaft 57 against the urging of springs 66A and 66B along guide slots 64A and 64B thereby to unlock cyclometer drums 23. When pinions 63 are displaced outward by the motion of pinion shaft 57, one or more axially short teeth 68 on each pinion 63 enters its respective window 67 and locks pinion 63 against rotation during the resetting operation. Upon completion of resetting, pinions 63 are urged back into mesh engagement with their respective cyclometer drums 23. Locking pinions 63 in predetermined angular positions, as is accomplished by windows 67, ensures that when engagement is attempted following resetting, axially short teeth 68 and axially long teeth 69 of all pinions 63 are in correct angular positions to properly engage their mating elements.

Although the present invention should not be considered to be limited by the materials from which its elements are made or the exact dimensions of such elements, for completeness of disclosure, the following details are provided. Drum shaft 24 is preferably of stainless steel with a diameter of about 0.125 inch and a length of about 3.75 inches. Teeth 54 are integrally formed by stamping from the material of drum shaft 24. Alternatively, drum shaft 24 and teeth 54 may be integrally formed of a plastic material. If a plastic material is used, it is preferably of a type which is capable of being injection molded and is most preferably of a type containing long glass fibers to resist breakage of teeth 54.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A reset mechanism for a cyclometer register of a type having a plurality of cyclometer drums on a drum shaft, comprising:

resilient means for urging said drum shaft into a first axial position;

means for permitting manually displacing said drum shaft into a second axial position against an urging of said resilient means;

at least two teeth on said drum shaft;

an abutment on at least two of said cyclometer drums;

said teeth and said abutments being mutually positioned to permit abutment therebetween during rotation of said drum shaft when said drum shaft is manually displaced into said second axial position, whereby manual resetting of said cyclometer register is enabled;

said teeth and said abutments being further mutually positioned to avoid abutment therebetween when said drum shaft is in said first axial position whereby normal operation of said cyclometer register is enabled without a retarding friction being applied by said reset mechanism;

at least one carry pinion between first and second of said cyclometer drums;

a pinion shaft upon which said at least one carry pinion is rotatably disposed;

second resilient means for urging said carry pinion into engagement with said first and second cyclometer drums;

said second resilient means including guide means for permitting said at least one carry pinion to displace out of engagement with said first and second cyclometer drums during said rotation; and means for locking said at least one carry pinion in a predetermined angular position while it is out of engagement with said first and second cyclometer drums whereby a resumption of engagement between said at least one carry pinion and said first and second cyclometer drums at the end of said rotation of said drum shaft is enabled.

2. A reset mechanism according to claim 1 wherein said resilient means includes a spring.

3. A reset mechanism according to claim 1 wherein said at least two teeth are integrally formed on said drum shaft.

4. A reset mechanism according to claim 3 wherein said drum shaft is metal and said at least two teeth are stamped of said metal.

5. A reset mechanism according to claim 3 wherein said drum shaft and said teeth are integrally formed of plastic.

6. A reset mechanism according to claim 5 wherein said plastic includes glass fibers.

7. A reset mechanism according to claim 1 wherein said means for locking includes at least one window normally disposed adjacent said at least one carry pinion, said guide means being effective for guiding a tooth of said at least one carry pinion into said at least one window, said at least one window having a dimension effective for preventing rotation of said at least one carry pinion and thereby for locking said at least one carry pinion into said predetermined angular position.

8. A reset mechanism for a cyclometer register of a type having a plurality of cyclometer drums on a drum shaft, comprising:

resilient means for urging said drum shaft into a first axial position;

means for permitting manually displacing said drum shaft into a second axial position against an urging of said resilient means;

at least two teeth on said drum shaft;

an abutment on at least two of said cyclometer drums;

said teeth and said abutments being mutually positioned to permit abutment therebetween during rotation of said drum shaft when said drum shaft is manually displaced into said second axial position, whereby manual resetting of said cyclometer register is enabled;

said teeth and said abutments being further mutually positioned to avoid abutment therebetween when said drum shaft is in said first axial position whereby normal operation of said cyclometer register is enabled without a retarding friction being applied by said reset mechanism;

at least one carry pinion between first and second of said cyclometer drums;

a pinion shaft upon which said at least one carry pinion is rotatably disposed;

second resilient means for urging said at least one carry pinion into engagement with said first and second cyclometer drums;

said second resilient means including guide means for permitting said at least one carry pinion to displace out of engagement with said first and second cyclometer drums during said rotation;

means for locking said at least one carry pinion in a predetermined angular position while it is out of engagement with said first and second cyclometer drums whereby a resumption of engagement between said at least one carry pinion and said first and second cyclometer drums at the end of said rotation of said drum shaft is enabled; and said means for locking including at least one window normally disposed adjacent said at least one carry pinion, said guide means being effective for guiding a tooth of said at least one carry pinion into said at least one window, said at least one window having a dimension effective for preventing rotation of said at least one carry pinion and thereby for locking said at least one carry pinion into said predetermined angular position.

* * * * *